United States Patent [19]

Metzger et al.

[11] 4,171,747

[45] Oct. 23, 1979

[54] HEADS ON SHRIMP SORTER

[76] Inventors: Shirley J. Metzger, 2025 S. Parkwood, Harlingen, Tex. 78550; James W. Smith, 402 Del Mar, Corpus Christi, Tex. 78418; Juan C. Leal, 801 S. "K", Harlingen, Tex. 78550

[21] Appl. No.: 826,172

[22] Filed: Aug. 19, 1977

[51] Int. Cl.[2] ..... B07C 9/00

[52] U.S. Cl. ..... 209/658; 209/666; 209/932; 209/914

[58] Field of Search ..... 209/105, 73, 74, 75, 209/658, 666, 932, 914

[56] References Cited

U.S. PATENT DOCUMENTS

| | | | |
|---|---|---|---|
| 2,582,007 | 1/1952 | Christiansen | 209/105 |
| 2,728,455 | 12/1955 | Greiner | 209/99 |
| 3,643,799 | 2/1972 | Sheetz | 209/73 |
| 3,784,007 | 1/1974 | Skrmetta | 209/99 |
| 4,016,625 | 4/1977 | Mitchell | 209/99 |

*Primary Examiner*—Allen N. Knowles

*Attorney, Agent, or Firm*—Arthur M. Dula; Murray Robinson; Ned L. Conley

[57] ABSTRACT

Shrimp are introduced individually onto a rotating disk inward of an adjustable gauging strip fixed above the disk's surface. Shrimp passing under the gauging strip under the influence of centrifugal force and are channeled to a first output chute. Those retained by the strip exit the disk through a second output chute. Disks may be ganged vertically to provide a plurality of sorted grades or in parallel for increased throughput.

6 Claims, 16 Drawing Figures

HEADS ON SHRIMP SORTER

BACKGROUND OF THE INVENTION

1. Field of the Invention

The present invention relates generally to sorting apparatus having an adjustable gauging strip spaced above a portion of a rotating disk. More specifically the present invention relates to an apparatus used to sort marine crustacean, or other delicate objects, by sequentially passing such objects through a series of gauging operations.

2. Background of the Prior Art

Today as in the past, shrimp are sorted by hand. Hand sorting is expensive and slow. A number of devices have been developed to mechanically sort live shrimp, but none of them has achieved any significant degree of commercial success. This lack of commercial success reflects the prior arts failure to teach a device that is capable of successfully sorting live shrimp.

For example, U.S. Pat. No. 2,989,180 describes a shrimp sorter that operates by passing shrimp down a channel between a plurality of elongated rollers having stepped peripheral surfaces. This device is impractical for two reasons. First it is mechanically complex and expensive. Second, and more important, live and freshly killed shrimp are mechanically delicate. Specifically, they are easily damaged by premature separation of their head portion. Any device using rotating rollers as a gauging means will cause the shrimp's head to be pinched off. The headless shrimp is then missorted, which defeats the object of the invention.

Hand sorting, aside from being dull, monotonous and low-paying work, has a number of inherent and serious disadvantages.

Being slow, hand sorting of large catches cannot be done at sea. This means the entire catch must be brought to shore for sorting. Much of the catch may die in route. Additionally many shrimp caught are too small for commercial use, these are removed and thrown out rather than being returned to the sea to mature for a later harvest.

Because the work is dull and monotonous it is often done poorly.

Finally, shrimp is best when it is fresh. Even the best hand sorting produces shrimp that have been dead for a considerable period of time prior to freezing. Significant market demand exists for large perfect "heads on" shrimp. These shrimp must be fresh frozen while they are alive just after being caught. This demand cannot be satisfied at present because the shrimp's head portion turns a dark color immediately after death. Keeping the shrimp alive or hand sorting them at sea is economically unrealistic.

It is therefore an object of the present invention to provide an apparatus capable of meeting the long known need for rapid and efficient mechanical sorting of shrimp.

A further object of the present invention is to provide a mechanical shrimp sorter capable of being operated at sea on board a shrimp boat as well as in a fixed plant on land.

Still another object of the present invention is to provide a mechanical shrimp sorter capable of accurately sorting either heads on shrimp or tails only shrimp.

Yet a further object of the present invention is to provide a shrimp sorter capable of operating at sea to return to the sea alive all shrimp that are too small to be commercially valuable.

A final object of the present invention is to provide a sorting apparatus that can be gauged in series and/or in parallel to provide for additional thru-put and a plurality of grades output.

SUMMARY OF THE INVENTION

The present invention is a shrimp sorting apparatus comprising a means for delivering shrimp individually to a rotating sorting disk, a gauging strip adjustably set above a portion of the disk which acts as a "go-no go" sorting gauge for the body diameter of said shrimp, an outer wall annularly surrounding said disk for retaining the shrimp passing under the gauging strip and two chutes for receiving the sorted shrimp from different sections of the disk. Sorting disks can be stacked vertically to provide a plurality of sequentially sorted sizes of shrimp.

INDEX OF THE DRAWINGS

Figure 1:
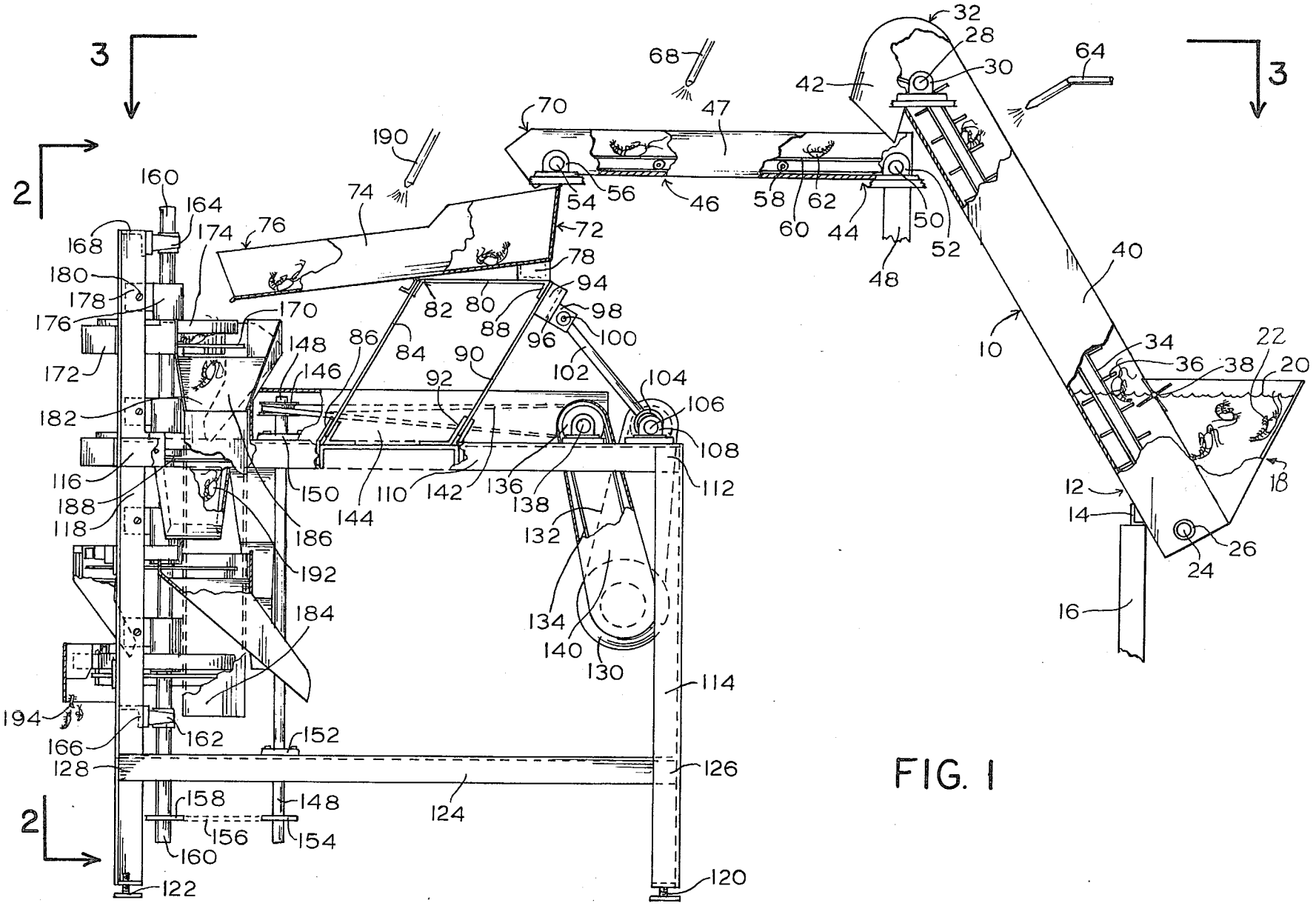
FIG. 1 is a schematic partially cutaway side view of a shrimp sorting apparatus constructed according to the preferred embodiment of the present invention.

10 Elevator
12 lower end of elevator 10
14 mounting bracket
16 upright
18 shrimp hopper
20 water level of hopper 18
22 shrimp
24 shaft
26 bearing
28 shaft
30 bearing structure
32 top of elevator 10
34 endless belt
36 uprights
38 small paddle structure
40 water tight external housing
42 forward extending downwardly pointing portion of upper end 32 of elevator 10
44 proximate end of conveyor structure 46
46 conveyor belt assembly
47 water tight housing
48 support
50 shaft end rollers
52 bearing
54 shaft end rollers
56 bearing structure
58 shaft
60 flexible belt
62 shrimp
64 water jet
68 water jet
70 end of conveyor 46
72 end of v-shaped separating trough 74
74 v-shaped separating trough
76 rear end of separating trough
78 block of elastomeric material
80 upper parallel support
82 end of upper support 80
84 vertical parallelogram support section
86 support structure
88 end of horizontal support structure 80
90 parallelogram upright
92 support
94 elastomeric material
96 plate
98 upper eccentric pivot structure
100 shaft
102 actuating shaft
104 eccentric actuator
106 shaft
108 bearing
110 horizontal frame member
112 front of frame member 110
114 front vertical frame member
116 rear of vertical frame member 114
118 rear vertical frame member
120 leveling pad
122 adjustable foot pad
124 horizontal support beam
126 point where front upright 114 is connected to lower horizontal support beam 124
128 point where support beam 124 is attached to rear upright 118
130 prime mover
132 belt
134 belt
136 pulley
138 shaft
140 belt guard
142 horizontal belt
144 belt guard structure
146 pulley
148 idler shaft
150 bearing structure
152 bearing structure
154 idler chain cog
156 chain drive
158 cog wheel
160 main shaft
162 bearing structure
164 upper bearing
166 angle iron
168 angle structural support member
170 rotating platter disk
172 housing
173 annular space
174 adjustable gauging strip
175 tangential of gauging strip
176 antenna guard
178 flange
180 bolt
182 transfer chute
184 lower end of chute 182
186 second chute
188 disk
200 vertical support member
202 horizontal support member
204 flanges
206 flanges
208 inner flanges
210 inner flanges
212 shrimp
214 sorting platter
218 chute
220 platter
222 chute
224 gauging strip
226 chute
228 lowest platter
230 gauging strip
302 bearing
304 horizontal support member
306 pulley
312 shrimp
314 commercially unvaluable shrimp
316 arrow
400 horizontal element
402 upright structural element
404 shaft
406 pulley
408 housing
410 pulley
500 strip
502 strip
504 bolt
506 rivet
508 rear support art
510 bolt
512 flange
514 longitudinal member
516 rivet
518 rivet 520 exit
522 small shrimp
526 inner portion
528 large shrimp
530 end of chute 186
532 position of shrimp
600 vertical slot
602 vertical slot
604 gauging gap
606 large shrimp
608 smaller shrimp
610 arrow
802 inner disk
804 lower large disk
806 annular opening
808 wall
810 product output chute
812 transfer chute
814 bridging support
816 screw
818 slot
820 side rail
822 point where side rail 820 is affixed to structural member 110
824 lower point where side rail 820 is affixed to structural member 124
826 small disk
828 cylindrical member
830 annular opening
832 disk
834 product chute
836 transfer chute
838 very small annular gap
840 transfer chute
842 angle support member
844 edge of transfer chute 812
846 leading edge of transfer chute 812
848 trailing edge of product output chute 810
850 straight portion of gauging strip 174
852 leading edge of product output chute 810
904 shrimp
906 small shrimp
1400 framework
1402 upper horizontal member
1404 lower horizontal member
1406 bearing structure
1408 bearing structure
1410 shaft
1412 stack of sorting modules
1414 vertical support member
1416 vertical support member
1418 structural member
1420 stack of modules
1422 sorting stack
1424 conveyor belt assembly
1425 moving belt
1426 vibrating v-trough assembly
1428 transfer v-trough
1430 output chutes
1432 conveyor belt
1434 dumping conduit
1600 vertical structural support
1602 top end of support 1600
1604 horizontal support member
1606 point where support 1600 is joint to member 1608
1608 lower horizontal support member
1610 horizontal bearing support member
1612 point where 1610 is attached to 1604
1614 horizontal bearing support structural member
1616 point where 1614 is attached to 1608
1618 horizontal bering support structural member
1620 point where 1618 is attached to 1604
1622 horizontal bearing support member
1624 point where 1622 is attached to 1608
1626 vertical belt support structural member
1628 upper end of 1626
1630 lower end of 1626
1632 vertical belt support structural member
1634 upper end of 1632
1636 lower end of 1632
1638 bearing
1640 lower bearing
1642 shaft
1644 bearing
1646 lower bearing
1648 vertical shaft
1650 sorting module
1652 sorting module
1654 sorting module
1656 sorting module
1658 sorting module
1660 sorting module
1662 sorting module
1664 sorting module
1666 conveyor belt
1667 conveyor belt
1668 conveyor belt
1670 conveyor belt
1672 shrimp
1674 rotating platform
1676 shrimp
1678 gauging strip
1680 cylindrical wall
1682 lower disk
1684 transfer chute
1686 chute
1688 shrimp
1690 gauging shrimp
1692 disk
1694 output chute
1696 transfer chute
1698 gauging strip
1700 disk
1702 output chute
1704 shrimp
1706 shrimp
1708 transfer chute
1710 disk
1712 gauging strip
1714 output chute
1716 shrimp
1718 lower disk

DESCRIPTION OF THE PREFERRED EMBODIMENTS

FIG. 1

FIG. 1 shows a schematic partially cutaway view of a shrimp sorting apparatus constructed according to a first preferred embodiment of the present invention.

Structure

Elevator 10 is affixed at its lower end 12 to mounting bracket 14. This mounting bracket is affixed to upright 16 which is structurally capable of supporting the elevator mechanism. The bottom of elevator 10 operably engages a shrimp hopper 18. Hopper 18 is partially filled with water to level 20. Shrimp 22 are in the water.

Shaft 24 is rotatably mounted in bearing 26 at bottom 12 of elevator 10. Shaft 28 is rotatably mounted in bearing structure 30 near top 32 of elevator 10. An endless belt 34 is moveably mounted on and between shafts 24 and 28. Belt 34 has a plurality of regularly spaced uprights 36 that extend orthogonally across its surface. A small paddle structure 38 is rotatably mounted at water level 20. Paddle 38 is rotated by a prime mover, not shown.

One end of shaft 24 is connected to a prime mover, not shown. Elevator 10 is covered by a water tight external housing 40.

Upper end 32 of elevator 10 has a forward extending downwardly pointing portion 42 which is placed over and proximate end 44 of conveyor belt assembly 46.

Conveyor belt assembly 46 is attached to support 48 by any convenient means capable of sustaining its weight. At end 44 of conveyor structure 46 a shaft 50 is mounted in bearing 52. At the other end of conveyor 46 second shaft 54 is rotatably mounted in bearing structure 56. A plurality of idler shafts 58 are rotatably mounted parallel and between shafts 50 and 54. A wide flexible belt 60 engages end rollers 54 and 50 and idler rollers 58. Belt 60 supports shrimp 62.

Water jet 64 above elevator 10 is connected to a source of pressurized water, not shown, and constantly sprays the elevator to wet-down the shrimp. Water jet 68, above belt 60, also connected to a supply of pressurized water, not shown, constantly sprays shrimp 62 on the moving belt.

Conveyor section 46 is covered on its sides by a water-tight housing 47. End 70 of conveyor 46 is positioned proximate and above end 72 of a v-shaped separating trough 74. Front end 72 of separating trough 74 is higher than its rear end 76.

Front end 72 of separating trough 74 is affixed to a block of elastomeric material 78, which, in turn, is affixed to upper parallel support 80 of a vibrating support structure. Upper support 80 is affixed to the middle portion of trough 74 at end 82. End 82 is bent into an angle to allow connection of section 80 with vertical parallelogram support section 84. Section 84 is attached at its lower end to support structure 86. End 88 of horizontal support structure 80 is fixedly connected to second parallelogram upright 90 whose lower end is fixedly connected to support 92. These connections may be made by welding, screws or any other convenient fastening means.

The outer side of the upper end of parallelogram support 90 is fixedly attached to a second block of elastomeric material 94. This elastomeric material is bonded on its outer side to plate 96, which is, in turn, attached to upper eccentric pivot structure 98. Shaft 100 is rotatably mounted in pivot bearing 98 and attached to the upper end of eccentric actuating shaft 102. The lower end of eccentric actuating shaft 102 is affixed to a rotating eccentric actuator 104 which is mounted off center on shaft 106. Shaft 106 is rotationally mounted in bearing 108. Both bearing 108 and supports 86 and 92 are attached to upper horizontal frame member 110. Upper horizontal frame member 110 is affixed at its front end 112 to front vertical frame member 114 and at its rear end 116 to rear vertical frame member 118. These frame connections may be made by welding, bolting or any other convenient means for affecting a secure fastening. The frame members are normally steel angle sections but may be made of any material, i.e. aluminum or wood, that are strong enough to support the invention's weight.

The lower end of vertical structural member 114 is equipped with a screwably adjustable leveling pad 120. The lower end of rear vertical upright member 118 is equipped at its lower end with a screwably adjustable foot pad 122. Front upright 114 is connected between bottom pad 120 and top 112 to lower horizontal support beam 124 at point 126. The rear end of support beam 124 is attached at point 128 to rear upright structural member 118.

A prime mover 130 is affixed to upright support beam 114 between point 126 and top 112. Prime mover 130 is preferably an electric motor having output shafts on both of its sides. Pulleys are mounted on each of these output shafts. One shaft is connected to its pulley through a reduction gear mechanism. This allows each of the motor's output shafts to turn at a different speed. These pulleys are not shown in FIG. 1, but are well known in the art and are expressly shown in later Figures in this specification.

As viewed in FIG. 1 the rear pulley drives a belt 132 which is connected between said drive pulley and a second pulley, not shown, fixedly attached to shaft 108 of eccentric structure 104.

The front pulley in FIG. 1 engages belt 134 which engages pulley 136 mounted on shaft 138, which is affixed to upper support member 110 just behind bearing structure 108. Belt 134 is covered by a belt guard 140 for the purpose of safety. Shaft 138 also engages a second pulley, not shown, which is operationally attached to horizontal belt 142. Horizontal belt 142 makes a half turn within belt guard structure 144 to operationally engage pulley 146 fixedly mounted on idler shaft 148.

Idler shaft 148 is supported by bearing structure 150 near its top end and by bearing structure 152 near its bottom end. Still nearer its bottom end, idler shaft 148 is fixedly attached to idler chain cog 154. Bearing structures 150 and 152 are mounted on a horizontal support members 110 and 124, respectively. Idler cog wheel 154 engages chain drive 156 which in turn engages driving cog wheel 158 which is fixedly attached to main shaft 160. Main shaft 160 is supported by bearing structures 162 mounted near its lower end and 164 near its upper end. Bearing structure 162 is mounted on an angle iron 166 which is fixedly attached to upright structural member 118. Upper bearing 164 is affixed to an angle structural support member 168 which is fixedly attached to upright structural member 118.

A first rotating platter 170 is fixedly attached to shaft 160 well below bearing 164. Platter 170 rotates inside a housing 172. An adjustable gauging strip 174 is mounted inside housing 172 and above disk 170. An antenna guard 176 lies inside strip 174 and is attached by its flange 178 and bolt 180 to a cross-bar strip, not shown. The lower end of antenna guard 176 extends into close proximity with the inner portion of disk 170. Details of this structure are discussed below in conjunction with FIGS. 5, 6 and 7.

Housing 72 extends annularly proximate the outer edge of platter 170 and terminates at a transfer chute 182 which extends down the entire length of the side of the sorting structure. Chute 182 is shown by broken lines for convenience. The lower end 184 of chute 182 is placed so that its output is dumped overboard if the sorting mechanism is on a ship.

A second chute 186 also extends from housing 172. It is radially spaced apart in the direction of the platter's rotation from chute 182. Lower end of chute 186, which is shown hidden as a dotted line structure, is proximate the surface of disk 188 inward of its associated gauging strip. Disk 188 is fixedly attached to shaft 160 and forms a portion of a second sorting structure.

FIG. 1 shows four vertically displaced sorting disks and associated structures on a single main drive shaft 160. These sorting modules are identical except for the setting of their adjustable gauging means and the radial disposition of their output chutes around the mechanism. Each of the lower three sorting disks receives its input product from an output chute of the disk above it. Thus the output chutes must be radially displaced from one another. The details of the sorting mechanism are given in connection with FIGS. 5 through 7 below.

Materials

The entire structure of the present invention is made of materials completely familiar to the mechanical engineer. The bearing shafts and structural support members are preferably made of material that will not rust or decay in a damp environment. Elevator belt 34 and conveyor belt 60 are flexible belts well known to industry. The vibrator eccentric prime mover and power transfer arrangements are regular v-belts, except for chain 156. Sorting platters 170, gauging strips 174, and other hardware such as antenna guard 176 are made of a rust resistant steel alloy in the preferred embodiment, but may be made of any material capable of performing the mechanical functions required by the apparatus. Water jets 64, 68, 190 are spray nozzles which provide lubricating water to the elevator conveyor belt and separating trough of the present invention, respectively.

Function

Fresh shrimp are dumped into tank 18 at the bottom of elevator 10. These shrimp are segregated into small allotments by paddle-wheel structure 38, which is well known in the art of moving small crustacean, and deposited between the vertical ribs 36 of elevator belt structure 34. The prime mover, not shown, rotates shaft 24 causing the elevator to carry shrimp upward toward the top of the elevator. When the shrimp reach the turn around point of belt 34 at bearing structure 28, they are dumped onto the aft end 44 of conveyor belt 60 which is part of conveyor belt mechanism 46.

A prime mover, not shown, rotates shaft 50 counterclockwise, causing conveyor belt 60 to move the single or small numbers of shrimp toward end 70, which may be any convenient distance away. When the shrimp reach end 70 of conveyor belt mechanism 46 they are dumped individually or a few at a time into vibrating separating trough 74. Prime mover 130 actuates belt 132, which in turn actuates eccentric 104 through shaft 102 causing trough 74 to make a rapid back and forth motion. This rapid back and forth motion combined with the lubrication from water jet 190 causes the shrimp to separate and align longitudinally so they may be individually deposited at end 76 onto the surface of rotating disk 170 inside gauging strip 174.

Water jets 64, 68, 190 constantly lubricate the elevator transfer belt and separator trough, to keep the rather sticky live shrimp from becoming inextricably innertwined with one another.

Prime mover 130 also actuates belt 134, which rotates shaft 138. A pulley, not shown, on shaft 138 operationally engages belt 142, which causes pulley 146 to rotate with idler shaft 148. Idler shaft 148 is connected by chain drive 156 at its lower end so as to rotate main shaft 160 at approximately 350 rpm. The rotational speed of the platter must be high enough to generate sufficient centrifugal force to cause the smallest shrimp on its surface to move outward. Platter 170, which is fixedly attached to shaft 160 also spins at approximately 350 rpm.

Each shrimp falls individually from lower end 76 of separator trough vibrating mechanism 74 and strikes the rotating surface of disk 170. Centrifugal force imparted to it by the disk's rotation impells the shrimp toward the outer edge of the disk. As will be described in detail later, each shrimp either passes or does not pass through the gauging space defined by platter 170 and gauging strip 174. The height of gauging strip 174 may be adjusted so as to grade out any desired size of shrimp.

Result

The preferred embodiment of the present invention illustrated in FIG. 1, sequentially grades shrimp through four sorting modules. Only the first sorting module is discussed in detail, it being understood that the others differ only in the setting of their respective gauging strips and the placement of their output chutes.

Platter 170 in FIG. 1 and its associated housing and gauging strip determine whether or not each shrimp fed onto the disk's surface is large enough to be work keeping. The gauging space defined between gauging strip 174 and disk 170 is adjusted to be sufficiently small that no commercially valuable shrimp will pass through it. Commercially worthless shrimp that do pass this narrow gauge fall through chute 182 and out its lower end 184. Thus they can be returned alive to the sea where they may grow larger to be harvested at a later time. All shrimp that are commercially valuable are retained by the gauging strip and exit from the first sorting module by rear chute 186. This chute deposits them, again individually, on the surface of second sorting disk 188 radially inward of its associated gauging strip.

The gauging strip of the second sorting module is adjusted to provide a gauging space that is large enough to pass all except very large shrimp. The largest shrimp are thus quickly segregated and may be frozen.

All remaining smaller commercially valuable shrimp pass through the gauging space and down a chute to the next to last and last sorting disks. These sorting disks have their gauging strips adjusted to grade shrimp of different sizes that may be valuable for different commercial purposes. For example, the second sorting wheel has segregated out those large shrimp 192 which would be useable for shrimp cocktails, while the output of the smallest commercially worthwhile gauging strip on the lowest wheel produces tiny cocktail shrimp 194 which may be bought up in mass to be sold canned in supermarkets.

A prototype of the apparatus shown in FIG. 1 is approximately 18 inches wide, 36 inches deep, and 48 inches high. Its shrimp sorting platters are approximately 30 inches in diameter. The prototype will grade approximately 600 pounds of shrimp per hour into four grades plus the reject small shrimp which can be returned to the sea.

FIG. 2

Figure 2:
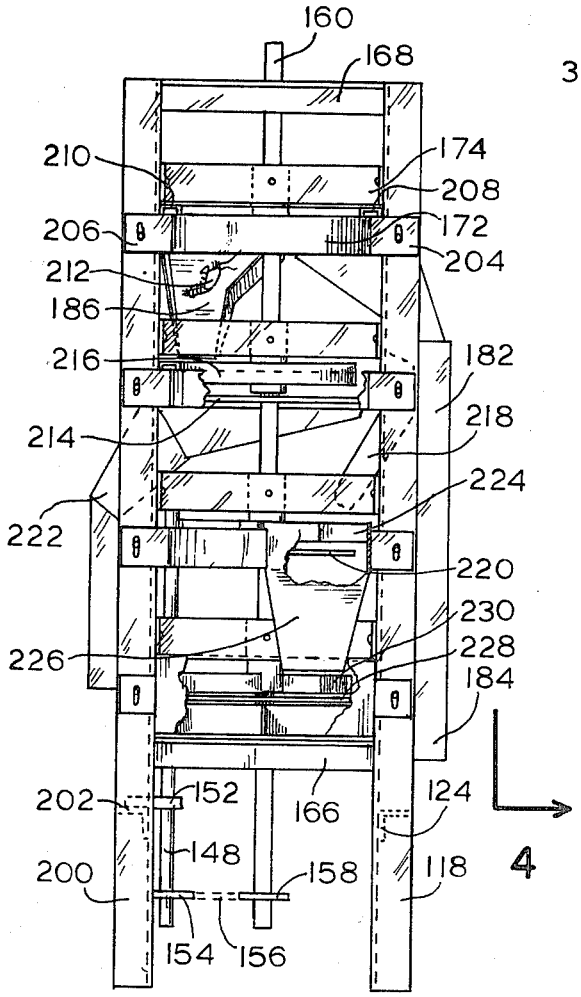
FIG. 2 is a view taken along lines 2—2 of FIG. 1 illustrating the adjustable gauging bars of the preferred embodiment of the present invention.

FIG. 2 shows a view of the apparatus shown in FIG. 1 taken along section lines 2—2, i.e. a rear view of the preferred embodiment of the present invention.

Structure

Angle supports 166 and 168 connect vertical support member 118 to second vertical support member 200. Vertical support member 200 which runs into the plane of FIG. 2 is also affixed to rear horizontal support member 202. Support member 202 supports bearing 152 and shaft 148. Housing 172 around top disk 170, not shown, is attached to vertical support members 118 and 200 by flanges 204 and 206 respectively. Each of these flanges is fitted with a vertically slotted adjustment opening allowing the height of support housing 172 to be adjusted with respect to disk 70. Support housing 172 is joined by inner flanges 208 and 210 to gauging means 174. Thus raising or lowering housing 172 controls the height of gauging strip 174 and sets the width of the gauging slot between the bottom of strip 174 and the surface of disk 170.

FIG. 2 illustrates that each sorting disk assembly has this type of moveable housing which may be individually set to provide different grades of output from each sorting step.

FIG. 2 also shows how chute 182 is disposed relative to housing 172 and platter 170. Chute 182 extends down to end 184 proximate the lower portion of the machine.

Function

As was discussed in connection with FIG. 1, above, reject shrimp too small to be commercially valuable may be dumped overboard through chute 182. Shrimp that do not pass through are retained by the gauging strip and carried radially around the platter to chute 186. Chute 186 carries shrimp 212 down to the second sorting platter 214 and deposits them radially inward of gauging strip 216.

As sorting disk 214 spins, shrimp that are capable of passing through the gauging space defined between the disk's upper surface and the bottom of strip 216 fall through chute 218 to platter 220. Shrimp that are too large to pass through this gauging opening are retained by the gauging strip and pass out chute 222 where they may be collected for quick freezing or other means of storage.

The lower end of chute 218 deposits the small shrimp from sorting platter 214 onto sorting platter 220 inward of gauging strip 224. This sorting module has a smaller gauging space than the module directly above it. As shrimp are individually deposited on sorting disk 220 by chute 218 they either do or do not pass through the gauging space defined between disk 220 and strip 224. If they do pass through the gauging space, then they are deposited by chute 226 onto the lowest platter 228 radially inboard of gauging strip 230. The shrimp that are too large to pass through the gauging space are retained by the gauging strip and pass out of the mechanism through a chute that is not shown in FIG. 2.

The lowest sorting module sorts the remaining shrimp into two grades which pass out of the machine by separate chutes not shown in FIG. 2.

Result

In every case gauging strips retain shrimp of or larger than a desired size and force them into a chute from which they may be collected and stored as graded shrimp. All remaining shrimp containing all smaller sizes are deposited on the next sorting wheel for sequential grading. The apparatus shown in FIG. 2 and discussed in this preferred embodiment has four sorting platters. This is an arbitrary number chosen because the inventor has experimentally tested a prototype of the invention using this number of platters and knows it works well. It should be obvious that any number of platters may be used to achieve desired gradiations of shrimp size.

FIG. 3

Figure 3:
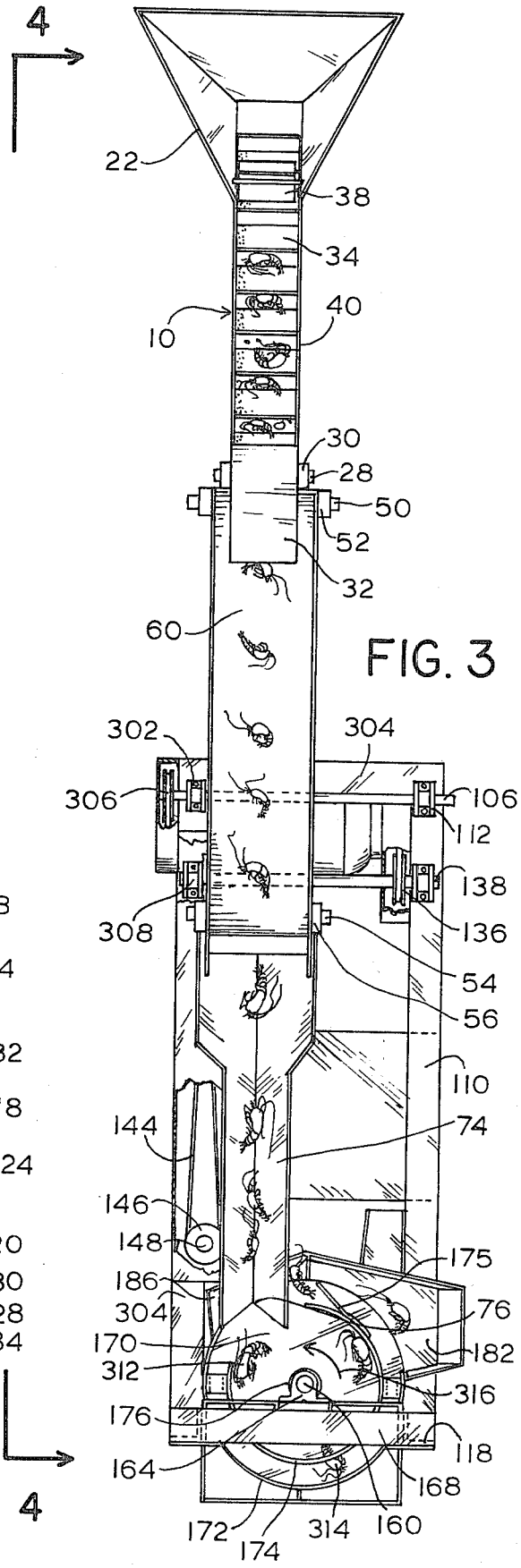
FIG. 3 is a view taken along section lines 3—3 of FIG. 1 illustrating a top view of the preferred embodiment of the present invention.

FIG. 3 is a view of the apparatus shown in FIG. 1 taken along section lines 3—3. It is an overhead view of the first preferred embodiment of the present invention.

Structure

Shaft 106 extends through bearings 112 and 302, which are mounted on horizontal support member 304. Pulley 306 is attached to the end of shaft 106 near bearing 302. Pulley 306 engages belt 32 operationally attached to prime mover 130.

Shaft 138 passes through its bearing structure on horizontal support 110, through pulley 136 and is rotatably received in bearing structure 308 affixed to horizontal support member 304.

Function

Shrimp are picked up out of tank 22 and placed on elevator 34 by paddle wheel structure 38. They move up to top 32 of belt 34 and are placed on conveyor belt 60. At the end of conveyor belt 60 the shrimp fall one or two at a time onto vibrating separating trough 74. The end 76 of trough 74 is arranged so it deposits shrimp 312 one at a time onto that section of disk 170 that will bring the shrimp radially inward of gauging strip 174.

Shrimp that are so small as to be commercially unvaluable 314 are impelled under the gauging strip by the centrifugal force of the rotating disk, which rotates in the direction shown by arrow 316. These small shrimp cannot fly off of disk 170 because wall 172 is annularly proximate the disk. They are carried by the disk's rotation around to the first point where wall 172 terminates. This termination of wall 172 defines the beginning of chute 182. The end of gauging strip 174 is bifurcated. A second tangential portion 175 forces all small shrimp on the outer part of disk 170 lying beyond strip 174 off into chute 182. The shrimp that are too large to pass through the gauging strip 312 are retained to the end of gauging strip 174. The first chance these shrimp have to be impelled off the rotating disk is when strip 174 ends, i.e. proximate the entrance to chute 186.

Result

Only shrimp too small to be commercially valuable have been sorted out and passed out of chute 182, all remaining commercially valuable shrimp travel down chute 186 to the next sorting level as was described in connection with FIGS. 1 and 2 above.

FIG. 4

Figure 4:
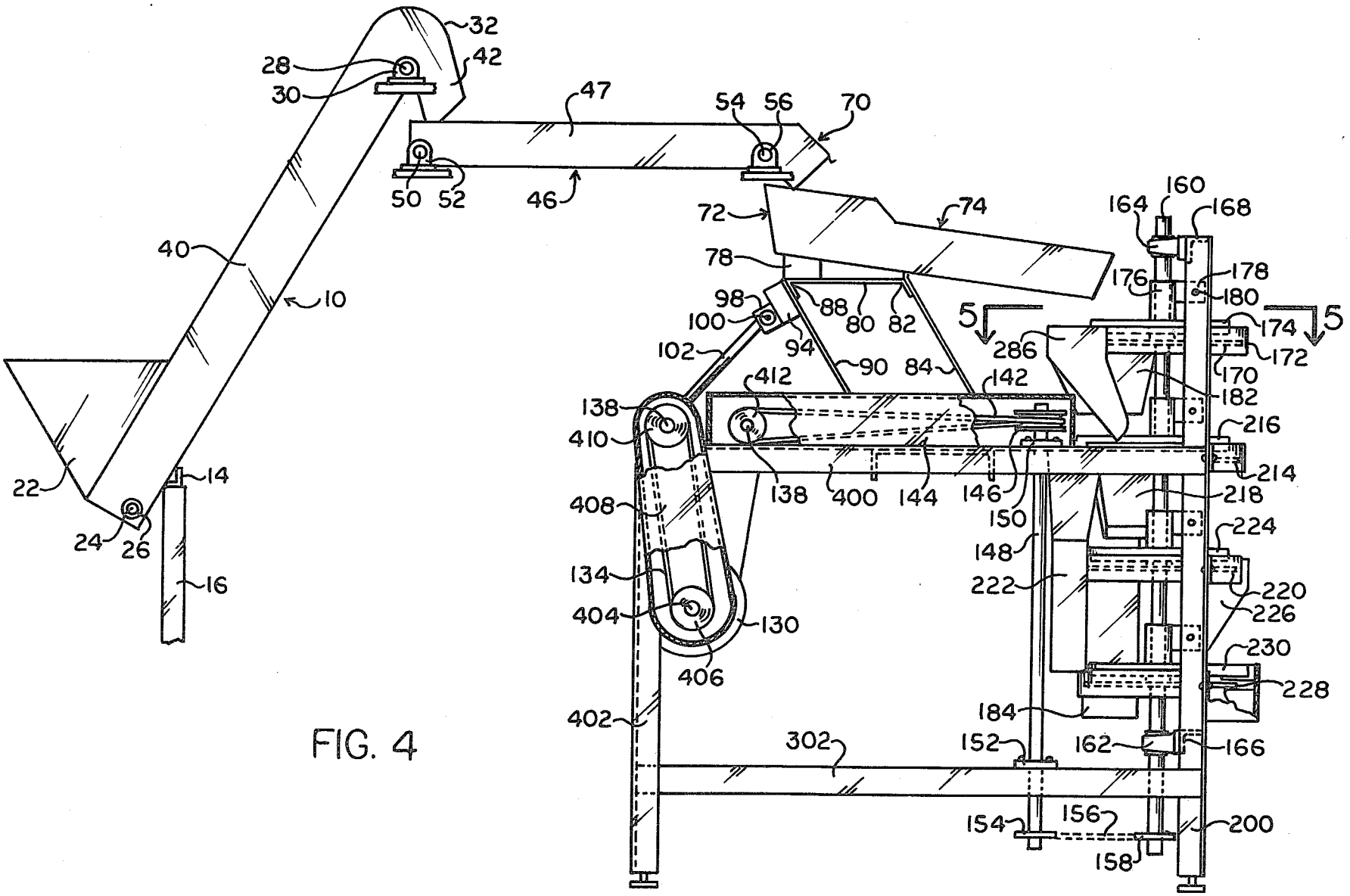
FIG. 4 is a view taken along section line 4—4 of FIG. 3 illustrating the other side of the preferred embodiment of the present invention.

FIG. 4 is a view along lines 4—4 of FIG. 3. FIG. 4 shows the opposite side of the sorting machine shown in FIG. 1

As was shown in FIG. 1, shrimp hopper 22 is connected to elevator 10 which deposits shrimp on transporter belt assembly 46 and thence onto vibrator separator 74.

As has not yet been shown in any Figure, upright structural element 200 is attached to a horizontal element 400 that is parallel to and above element 302. Both horizontal structural element 302 and 400 are connected toward the front of the machine to a upright structural element 402 which is parallel to structural element 114 of FIG. 1.

FIG. 4 shows prime mover 130, shaft 404, which is fixedly supporting pulley 406. Pulley 406 engages belt 134 within housing 408. Belt 134 operably engages pulley 410 that drives shaft 138. Shaft 138 drives eccentric 104, not shown in this illustration, which vibrates shaker separator trough assembly 74.

FIG. 4 shows the details of the structure of chute 286 as it proceeds from the level of wall 172 downward inwardly to the second sorting level proximate disk 214. Pulley 412 is also shown operably engaging belt 144 on shaft 138. Beyond these additional details that are visible only in this opposite side partially cutaway schematic view of the first preferred embodiment of the present invention all of the parts shown and numbered in FIG. 4 operate as was described in connection with FIGS. 1 through 3 above.

FIG. 5

Figure 5:
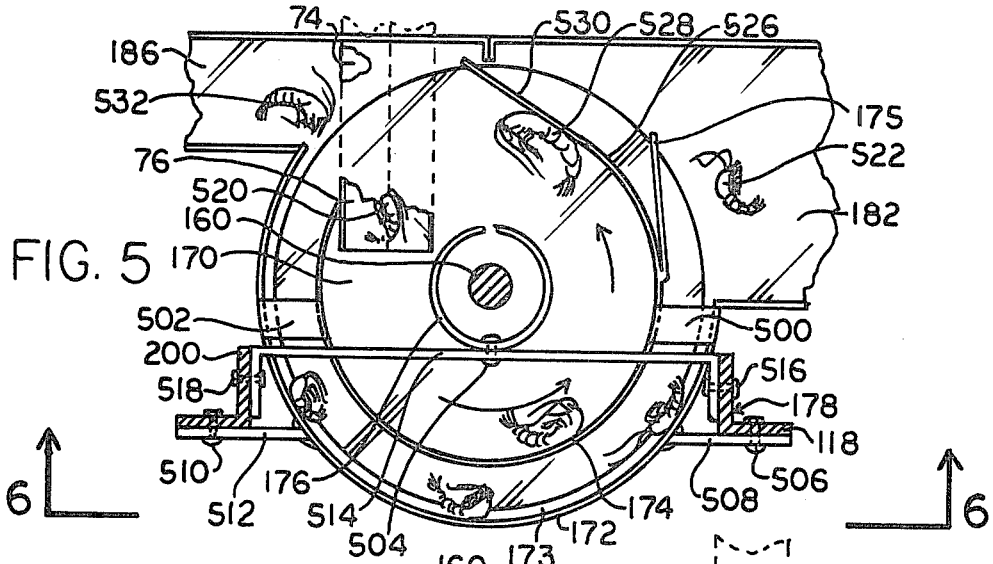
FIG. 5 is a view taken along section line 5—5 of FIG. 4 illustrating one sorting disk constructed according to the preferred embodiment of the present invention.

FIG. 5 is a somewhat schematic partially cutaway view taken along lines 5—5 of FIG. 4. FIG. 5 illustrates one sorting wheel and associated structure as seen from above in the first preferred embodiment of the present invention.

Structure

Vibrator chute 74 is shown in partial cutaway with its end 76 suspended over disk 70 radially inboard of gauging strip 174 as was described above. Disk 170 is rotatably affixed on shaft 160. Gauging strip 174 is attached by welding or other convenient means to support strips 500 and 502 which extend radially outward from the gauging strip and are affixed to the top of radial wall 172. Antenna guard 176 annularly surrounds shaft 160 and is attached by bolt 504 or other convenient means to bracket 178. Bracket 178 is attached by a bolt or rivet 506 to rear support arm 508. Rear support arm 508 is welded to the outer shell of annular wall 172. The opposite side of bracket 178 is connected by bolt 510, or other convenient means, to second mounting flange 512, which is similarly affixed to the outer radial wall 172 by welding or other convenient means.

Bracket 178 incorporates vertical supports 118 and 200 into its structure. The support structure consists of a longitudinal member 514 which is attached to circular member 176 by bolt 504. The ends of member 514 are bent at right angles and affixed to upright support angles 118 and 200 by rivets 516 and 518 respectively.

Function

The vibration of v-trough 74 aligns shrimp along the bottom of the trough and separates them so one shrimp at a time is deposited on rotating disk 170 inward of gauging strip 174. Both large and small shrimp 520 exit the end 76 of vibrator v-trough 74. Disk 170 is spinning at approximately 350 rpm in the preferred embodiment of the present invention. Centrifugal force impells each shrimp up against gauging strip 174. Those shrimp that are small enough to pass through the gauging space between the strip and the rotating disk move outward into the annular portion of disk 170 between gauging strip 174 and outer annular wall 172. The annular space 173 between the rotating disk and the outer annular wall 174 is not large enough to allow passage of any object. In the present invention it is approximately 1/10 of an inch.

Both the larger and the small shrimp are propelled radially around disk 170 in sliding contact with either gauging strip 174 or outer annular wall 172 by the rotation of disk 170. Outer annular wall 172 terminates into chute 182 and centrifugal force flings the small shrimp 522 out into the chute where it falls back into the sea or into a collection bin as desired.

Gauging strip 174 is aplit at point 152 into an outer portion 175 and an inner portion 526. Large shrimp 528 continue to slide along the gauging strip until they reach its end 530 proximate chute 186. The large shrimp then flies off the sorting wheel 170 as is illustrated by the position of shrimp 532 onto chute 186. These larger shrimp, which comprise all the shrimp that have any commercial value are conveyed by chute 186 to the next sorting level.

It is important to note that a plurality of shrimp may be present on the sorting wheel at any one time as long as shrimp are delivered individually to the wheel by vibrating trough 74. As was discussed above vibrating trough 74 acts to separate the shrimp so they may be individually deposited on the wheel.

FIG. 6

Figure 6:
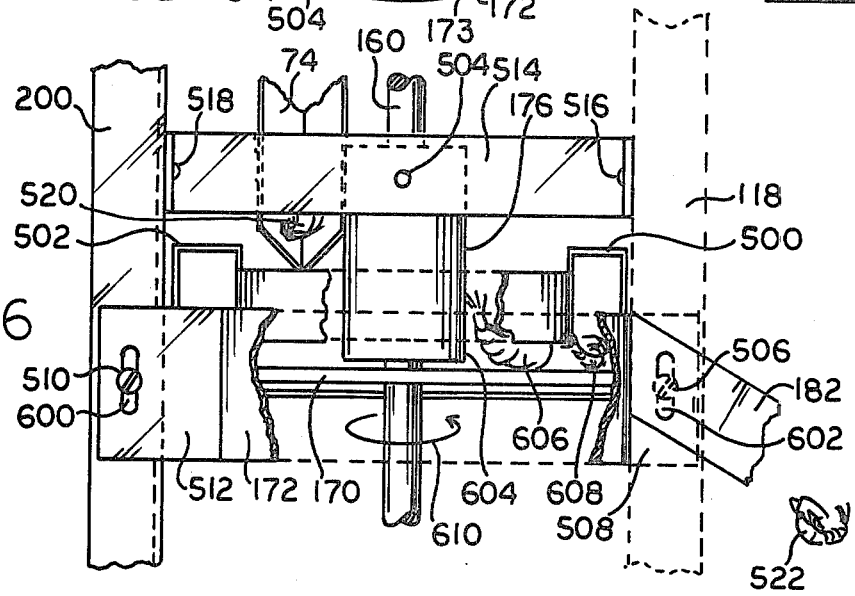
FIG. 6 is a view taken along section line 6—6 of FIG. 5 illustrating a rear schematic partially cutaway view of the sorting mechanism of the preferred embodiment of the present invention.

FIG. 6 shows a schematic partially cutaway view taken along lines 6—6 of FIG. 5. FIG. 6 illustrates a rear view of the adjustment details of the gauging strip taught by the present invention. Like numbers indicate like structures in this drawing.

In FIG. 6 the shrimp 520 exits v-trough 74 onto the portion of disk 170 inward of gauging strip 174. Gauging strip 174 is shown connected to support strips 500, 502 which in turn are connected to outer radial wall 172. Outer wall 172 has projecting flanges 512 and 508. Flange 512 and 508 are equipped with a vertical slot 600, 602, respectively. Screws 510, 506 adjustably hold flanges 600, 602, respectively, in a desired position. These screws may be adjusted and the position of outer radial wall 172 altered. Changing the position of outer radial wall 172 will raise or lower gauging strip 174 and thus increase or decrease the size of gauging gap 604.

As is shown in FIG. 6 large shrimp 606 cannot pass through gauging space 604 and move in sliding contact with gauging strip 174. Smaller shrimp 608 is shown passing through gauging gap 604. This small shrimp comes into sliding contact with outer annular wall 172 and is carried, as is large shrimp 606, toward the output chutes by the rotation of disk 170 in the direction indicated by arrow 610.

It is important to always adjust both sides of outer radial wall 172 so that gauging strip 174 is above and parallel to disk 170. This parallelism prevents shrimp from becoming caught between the gauging bar and the rotating disk.

FIG. 7

Figure 7:
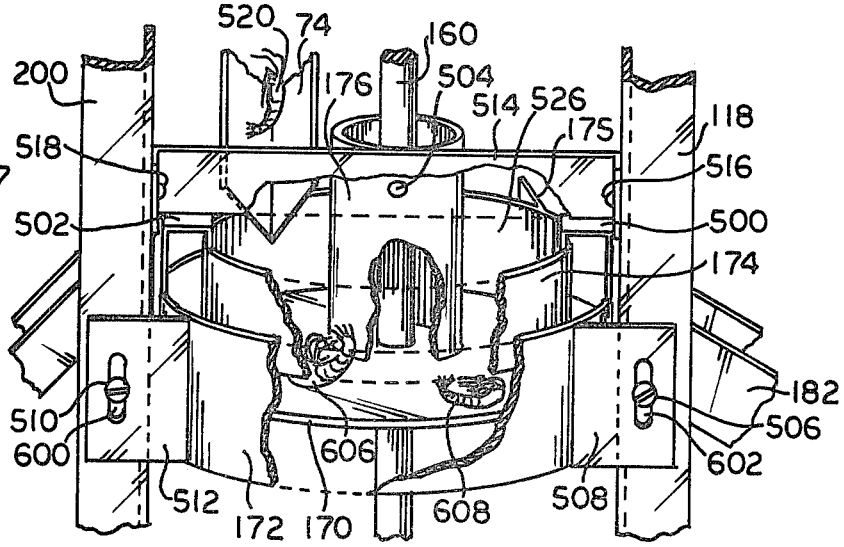
FIG. 7 is a partially cutaway isometric view of the sorting disk and apparatus illustrated in FIGS. 5 and 6.

FIG. 7 is an isometric view of a sorting platter and its associated structural members according to a first preferred embodiment of the present invention. Specifically this embodiment is the embodiment illustrated in FIGS. 5 and 6 above. Like numbers in FIG. 7 indicate like structures to FIGS. 5 and 6. FIG. 7 is provided primarily to give the reader a better understanding of how the structural parts shown in the orthogonal views 5 and 6 fit together in space to enable a person skilled in the art of mechanical engineering to make and use the present invention.

The entire structure and all components of the present invention must be built of corrosion resistent material because the movement of shrimp through the machine is accomplished by sliding and the shrimp must be kept lubricated to slide properly. This lubrication is generally accomplished by introducing a spray of salt water into various sections of the device, i.e. the device operates in a constant spray of salt water.

FIG. 8

Figure 8:
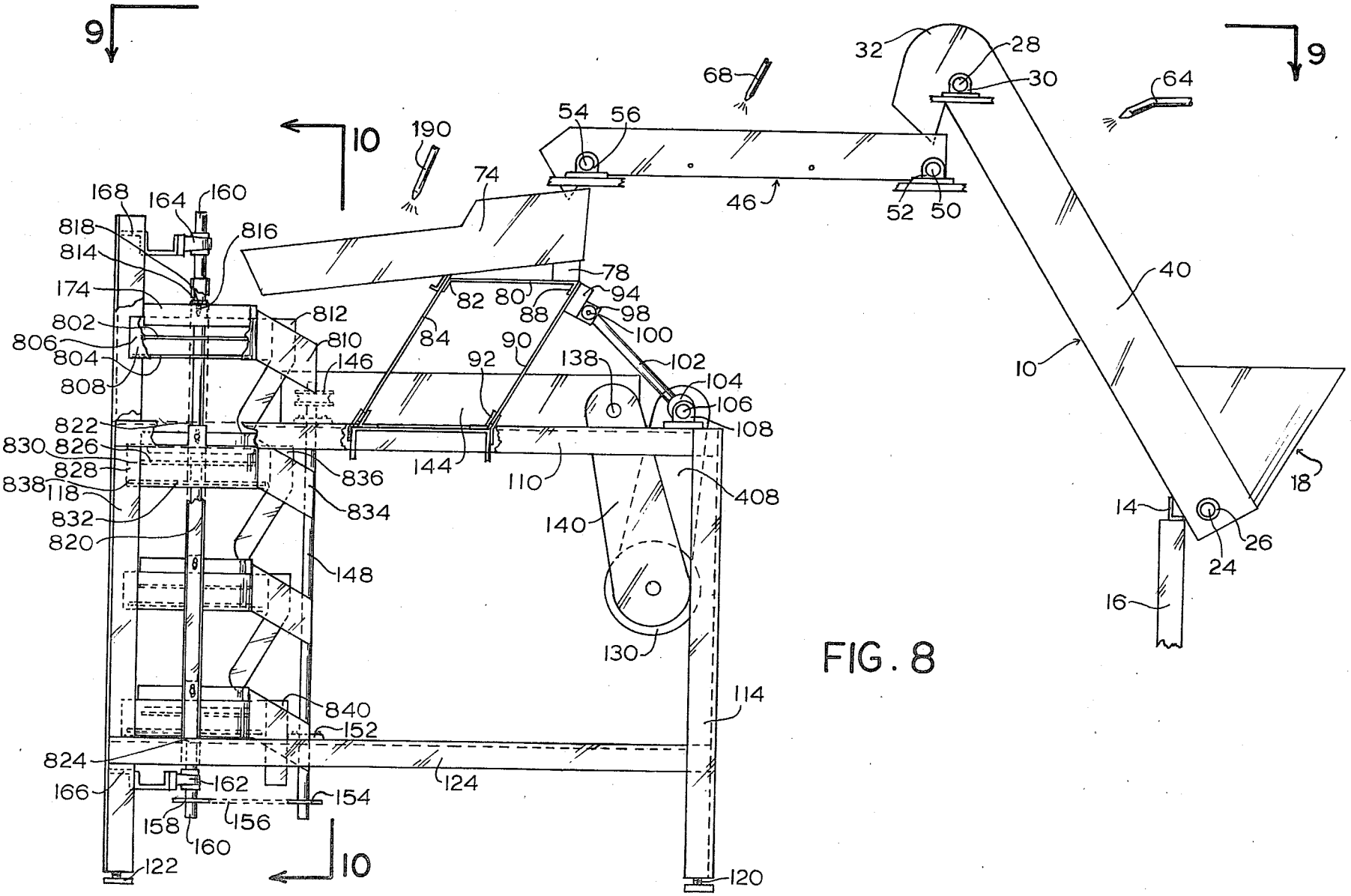
FIG. 8 is a schematic partially cutaway view of a second preferred embodiment of the present invention.

FIG. 8 illustrates a second preferred embodiment of the present invention. The first preferred embodiment of the present invention illustrated in FIGS. 1 through 7 above have output chutes that are out of alignment from disk to disk as the shrimp proceeds down the machine. This first embodiment is very useful for sorting up to approximately 1,000 pounds per hour of shrimp. The second preferred embodiment of the present invention is useful when sorting modules must be ganged together in parallel to handle larger volume of shrimp.

The basic difference is that this second preferred embodiment has two rotating platters, an upper smaller platter and a lower larger platter with sides affixed to the same rotating shaft for each grading unit.

The use of two platters is mechanically more complex and expensive, but permits the output and transfer chute of each platter to be aligned vertically one over the other. As will be shown later, this attribute is extremely helpful in arranging for conveyor belt systems to transport the sorted output of graded shrimp from each sorting level of the present invention.

All of the structural elements of the embodiment shown in FIG. 8 that are labeled with numbers corresponding to the numbers in FIG. 1 operate in exactly the same manner as those elements in FIG. 1. For the sake of brevity only the differences are discussed in detail in this specification.

Structure

Inner disk 802 is rotatably mounted on shaft 160. The outer edge of disk 802 is under and approximately even with gauging strip 174. Lower large disk 804 is affixed to shaft 160 below disk 802. Disk 804 is parallel to disk 802 and its diameter is sufficiently large to define an annular opening 806 between wall 808, whose lower edge is annularly proximate the outer edge of disk 804 and the circumferential edge of disk 802. Annular space 806 is at least as large or larger than the gauging space between the bottom of gauging strip 174 and the top surface of disk 802.

A product output chute 810 and transfer output chute 812 are located side by side on the front of the sorting module. As will be described in detail below, chute 810 removes the product shrimp that are retained by gauging strip 174 and transfer chute 812 removes the sorted shrimp retained on lower platter 804, i.e. the shrimp that have passed through the gauging means and fallen through the annular space 806 to the surface of the lower disk.

Cylindrical wall 808 is separated from lower platter 804 by a small annular space, which will be described below in connection with FIGS. 11 through 13. Cylindrical wall 808 and gauging strip 174 are mounted together by a bridging support 814 which is adjustably affixed by screw 816, which passes through slot 818, to side rail 820. Side rail 820 is an angular structural member affixed by welding or other suitable means to horizontal structural member 110 at point 822 and horizontal structural member 124 at lower point 824. Thus vertical side structural member 820 is parallel to vertical structural member 118.

The next lower sorting module in this embodiment of the present invention includes upper small disk 826 which is fixedly attached to shaft 160; cylindrical member 828, which defines annular opening 830 between the outer perimeter of disk 826 and the inner surface of cylindrical member 828; and lower larger disk 832 which is fixedly attached to shaft 160 below smaller disk 826. Product chute 834 and transfer chute 836 are operationally attached to the front of this sorting module directly beneath chutes 810 and 812, respectively. A very small annular gap 838 is defined between the circumferential edge of lower large disk 832 and the inner wall of cylindrical member 828.

The third and fourth sorting modules are identical to the first and second except for the adjustment of their gauging strips and associated connected cylindrical wall members to provide for sorting passage of different size shrimp. Transfer chute 840 on the lowest sorting module is not inwardly curved as were transfer chutes 810 and 836. This is because transfer chute 840 need not deposit its shrimp inward of the gauging strip on a lower sorting module, but may discharge its output onto a conveyor belt, into a basket or as otherwise desired.

Function

Up to the point that individual shrimp are delivered by vibrator v-trough assembly 74 to the upper surface of the smaller disk 802 inward of gauging strip 174, the embodiment of the present invention taught by FIG. 8 operates exactly as does the mechanism discussed in connection with FIG. 1, above. Like numbers indicate like parts in all drawings in this specification.

Each individual shrimp delivered to the upper surface of small disk 802 is impelled outward by the centrifugal force imparted to it by the disk's rotation. If the shrimp is small enough to pass between the bottom of the gauging strip and the top surface of disk 802, then it falls through annular space 806 onto lower rotating disk 804. The shrimp is then impelled outward by the centrifugal force imparted to it by the rotation of disk 804 until it reaches cylindrical wall member 808. The annular space between the bottom rotating disk 804 and cylindrical wall member 808 is so small that no shrimp can pass through it.

As a result larger shrimp are retained on upper platter 802 by gauging bar 174 while all smaller shrimp are retained on lower platter 804 by cylindrical wall member 808. Product chute 810 receives shrimp remaining on upper platter 802 and transfer chute 812 receives shrimp that have fallen onto lower platter 804.

All shrimp not retained by the gauging bar 174 pass through annular space 806 and are carried by lower platter 804 to transfer chute 812. They fall through the angled portion of transfer chute 812 and are deposited, individually, on the surface of the upper small disk 826 of the next lower sorting module inward of its associated gauging strip.

This sorting process is repeated in each module. Shrimp small enough to pass through the gauging space fall through annular space 830 and are retained by cylindrical wall 828 and lower disk 832. Rotation of the lower disk carries them around to transfer chute 836. Shrimp then pass through chute 836 and are deposited on the sorting platter of the next lower sorting module.

The illustrated embodiment of the present invention utilizes four sorting modules. This is a matter of design choice. Any number of modules may be utilized. The important feature taught by this embodiment of the present invention is that the product output and transfer chutes may be aligned vertically one under another. As will be described later in connection with FIGS. 14, 15 and 16, this attribute makes it possible to use this embodiment to construct a simple combination of conveyor belts for automatically removing graded products.

When shrimp reach the lowest sorting module, they are again sorted and the shrimp on the upper and lower platters are transferred out of the invention by chutes.

Result

The present embodiment achieves essentially the same result as the first embodiment described in connection with FIG. 1, above. Ungraded shrimp of many sizes are deposited on the first sorting module and graded shrimp come out of the product chutes of each sorting module in the device.

The present embodiment teaches two important differences from the earlier embodiment. First, all of its sorting chutes may be vertically aligned in radial coincidence and, second, small shrimp of no commercial value pass through all grading steps of this embodiment before they are discharged back to the sea. Alternatively, the position of the product chute and transfer chute could be reversed on the first sorting module. The sorting strip for the first module could then be set to retain all except commercially worthless shrimp and the product output chute could be elongated to return the smaller shrimp to the sea.

FIG. 9

Figure 9:
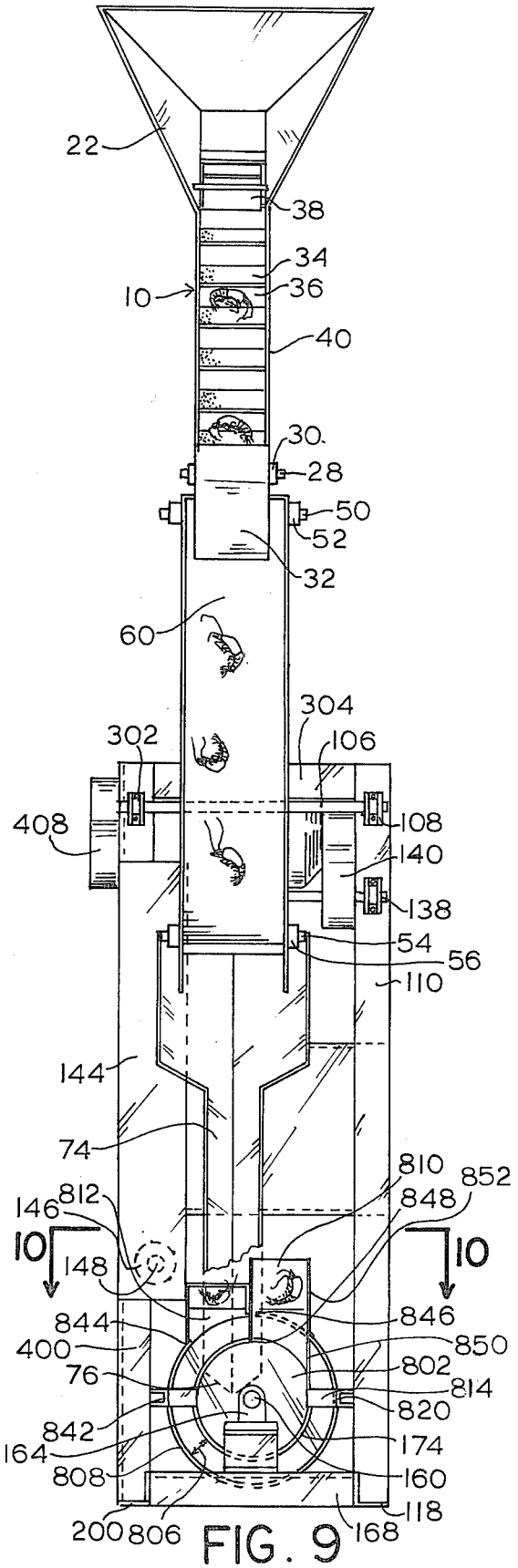
FIG. 9 is a view taken along section line 9—9 of FIG. 8 illustrating an overhead view looking down on the second preferred embodiment of the present invention.

FIG. 9 shows a view of the embodiment of the present invention discussed in connection with FIG. 8 taken along lines 9—9 of FIG. 8. This is a top view of the second preferred embodiment of the present invention. Similar numbers indicate similar structures in this drawing.

This drawing is in the specification to show the position of end 76 of transfer v-trough assembly 74. This end deposits shrimp on upper platter 802 inward of gauging strip 174. It also shows angle support member 842 which is located on the opposite side of cylindrical wall 808 from vertical support member 820.

Cylindrical wall member 808 begins at the edge 844 of transfer chute 812 and continues around the entire circumference of the sorting module till it terminates at leading edge 846 of transfer chute 812.

Similarly, gauging strip 174 begins at the trailing edge 848 of product output chute 810 and extends above in radial coincidence with the circumferential edge of upper disk 802 until it terminates in a straight portion 850 which is in line with the leading edge 852 of product output chute 810.

Functionally, shrimp are deposited individually on the upper surface of small sorting disk 802. Small shrimp pass through the gauging space between the lower edge of the gauging strip and the upper edge of the rotating disk, fall through annular space 806 onto bottom disk 804. Large shrimp are retained by gauging strip 174 and carried by rotation of disk 802 until they are impelled into product chute 820. The small shrimp retained by cylindrical wall 808 are carried by the rotation of larger disk 804 until they are impelled into transfer chute 812.

FIG. 10

Figure 10:
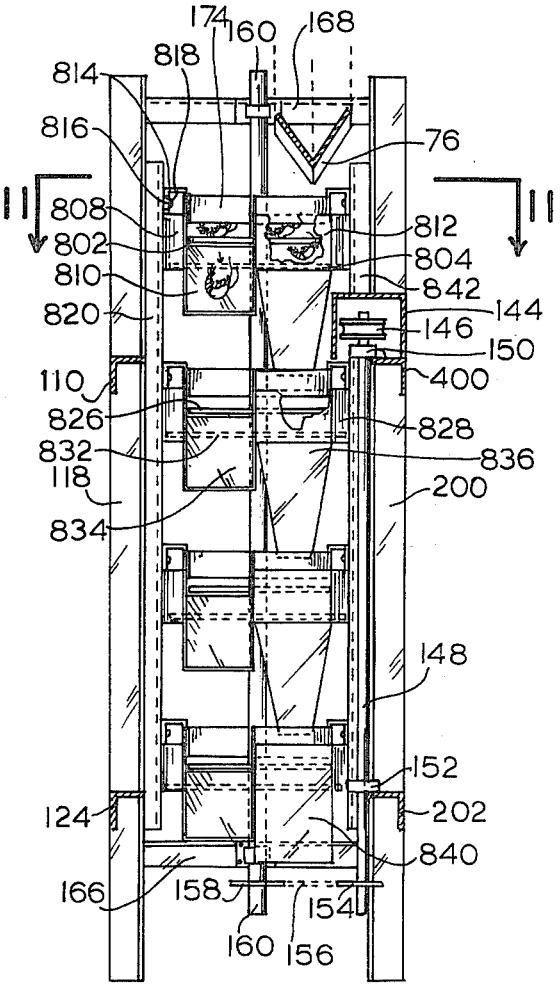
FIG. 10 is a view along lines 10—10 of FIG. 9 illustrating a rear view of the second preferred embodiment.

FIG. 10 is a sectional view of the second preferred embodiment of the present invention taken along lines 10—10 of FIG. 9. This is a view looking into the sorting chutes of this embodiment of the present invention and is generally equivalent to FIG. 2 for the first embodiment. Similar numbers in this drawing indicate similar structures.

The purpose of this drawing is to show the vertical arrangement of the product and transfer chutes associated with this embodiment of the present invention. The function of all the parts in the drawing and their structural relationships have been discussed in connection with FIGS. 8 and 9, above.

Figure 11:
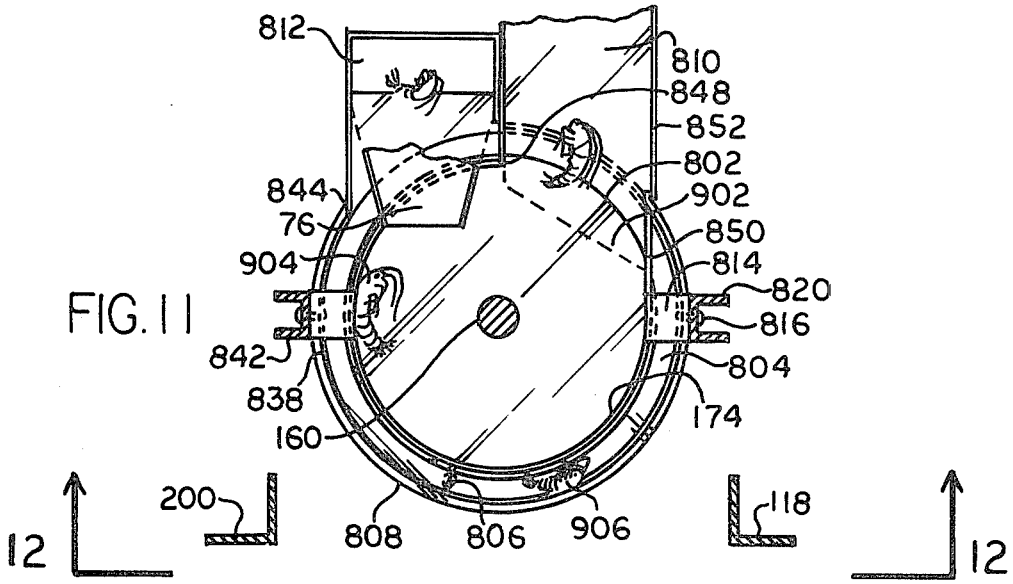
FIG. 11 is a view taken along lines 11—11 of FIG. 10 illustrating the sorting disks of the second preferred embodiment of the present invention.
Figure 12:
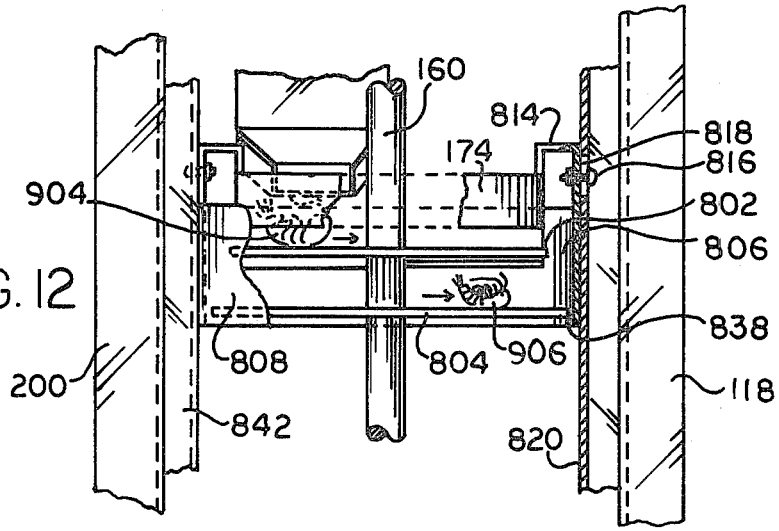
FIG. 12 is a view along lines 12—12 of FIG. 11 illustrating a partially cutaway side view of the disk assembly shown in FIG. 11.
Figure 13:
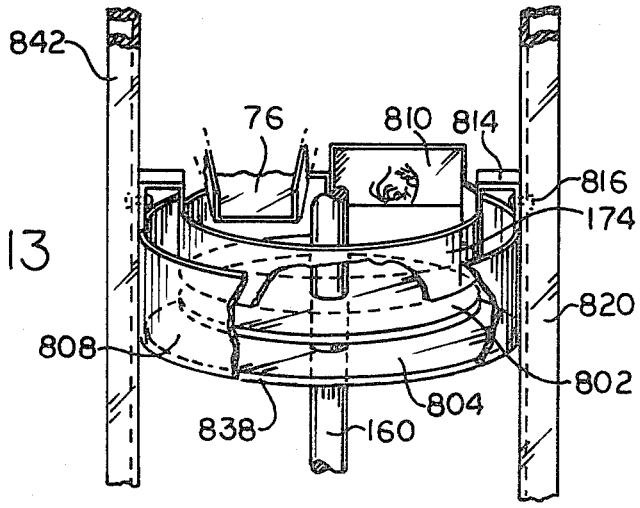
FIG. 13 is a partially cutaway isometric view of the disk sorting assembly illustrated in FIGS. 11 and 12.

FIGS. 11, 12 and 13

FIGS. 11, 12 and 13 will be discussed together because, when taken together, they illustrate the operation of one sorting module constructed according to the second preferred embodiment of the present invention.

Structurally, all elements shown in FIGS. 11, 12 and 13 have been described in detail in connection with drawings 8, 9 and 10. The one exception to this is lip 902 of product output chute 810 which extends under the outer margin of upper small disk 802.

Functionally, shrimp fall from the end 76 of vibrator v-trough 74 to the upper surface of small sorting disk 802. Large shrimp, such as shrimp 904 are retained by gauging strip 174 and carried by rotation of disk 802 to product output chute 810 where they exit the apparatus. Small shrimp, such as shrimp 906, pass through the gauging space between the bottom of the gauging strip and the top of disk 802. They then fall through annular space 806 to the top surface of lower disk 804. The shrimp are there restrained by cylindrical wall 808 and carried by rotation of disk 804 to transfer chute 812, where they exit this sorting module and are carried down and inward by a transfer chute to the small sorting disk of the next lower sorting module.

FIG. 14

Figure 14:
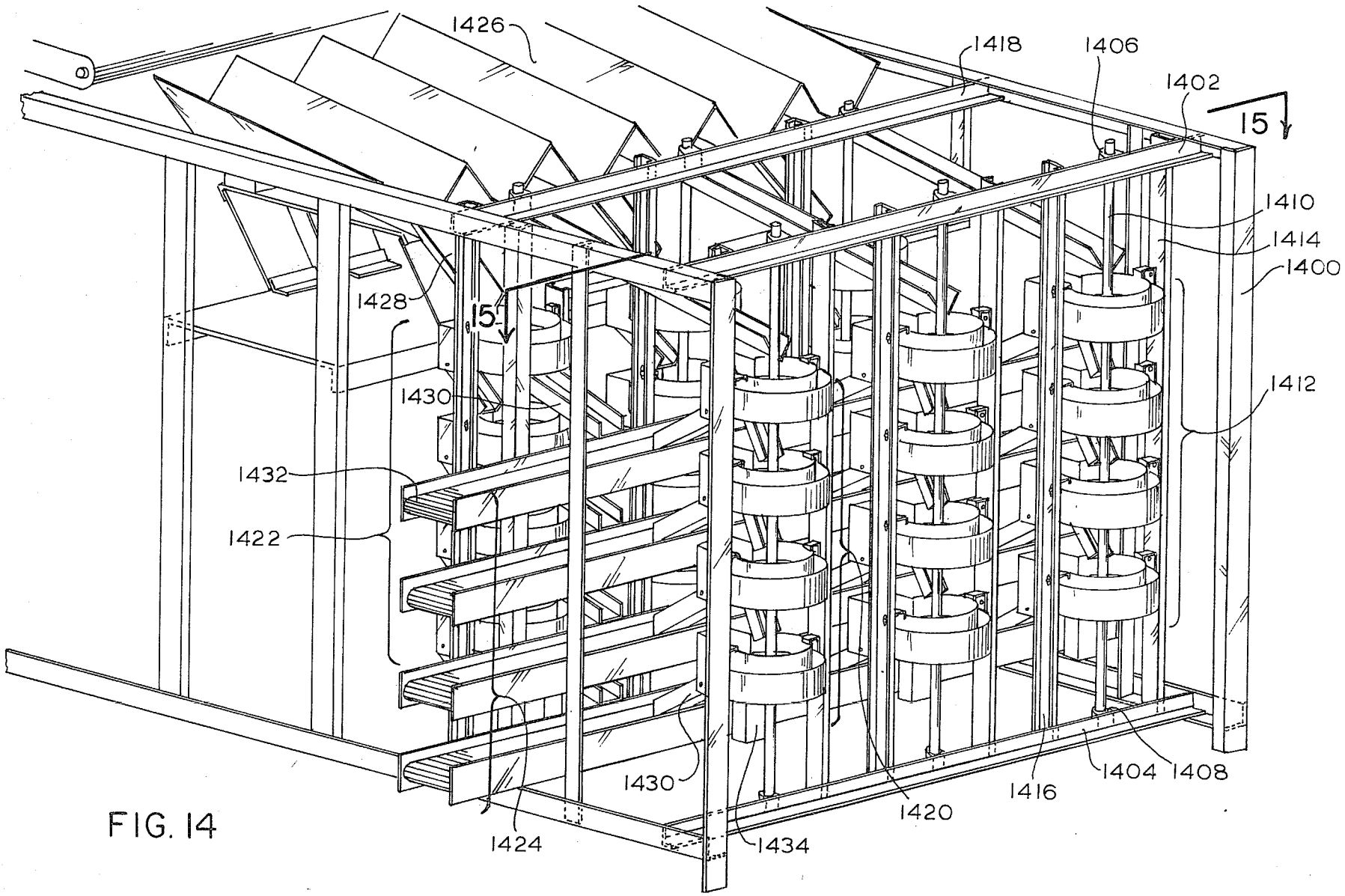
FIG. 14 is an isometric illustration of a gang sorting system constructed of individual sorting modules operated in parallel according to the second preferred embodiment of the present invention.

FIG. 14 shows an isometric view of a large production facility utilizing parallel stacks of sorting modules constructed according to the second preferred embodiment of the present invention.

FIG. 14 illustrates how the second preferred embodiment of the present invention utilizes the radial coincidence of product output chutes to allow various grades of sorted products to be transferred out of the mechanism via a system of conveyor belts. The drive mechanisms used to rotate the sorting disks have been omitted from this drawing to reduce its complexity.

Structure

Framework 1400 has an upper horizontal member 1402 and a lower horizontal member 1404. Bearing structures 1406 and 1408 are attached to horizontal members 1402 and 1404, respectively. Shaft 1410 rotationally engages bearing structures 1406 and 1408. A vertical series of four stacked sorting modules constructed according to the embodiment of the present invention described in connection with FIGS. 8 through 13, above, is mounted on shaft 1410. Vertical support members 1414 and 1416 provide structural support for the adjustable portions of each sorting module. Horizontal support members 1402 and 1404 support two other stacks of modules that are duplicates of stack 1412. A second set of three sorter module stacks are affixed at their upper end to horizontal structural member 1418. These latter three sets of stacked modules are located parallel to the first three sets containing module 1412.

As viewed in FIG. 14, the front stack of modules 1420 affixed to support member 1402 and 1422 affixed to structural member 1418 have interdisposed between them conveyor belt assembly 1424 comprising four parallel conveyor belts. The product output chutes from each level of the sorter stacks all discharge their product output onto the same belt.

A multiple v-trough vibrator separator is located aft of the second described set of three stacked module units attached to structural support 1418. Alternating long and short transfer v-troughs 1428 extend from the terminus of vibrating v-trough assembly 1426 to proximate and above the upper surface of the upper small sorting platters the top level sorting modules inward of their respective gauging strips.

Function

A variety of sizes of shrimp are deposited one at a time from vibrator v-trough structure 1426 through delivery chutes 1428 onto the upper small disk of the top sorting module of each stack of modules inward of its associated gauging strip.

The sorting operation then occurs exactly as was described in connection with FIGS. 8 through 13, above.

Output chutes 1430 convey the sorted product retained by the gauging strips of all of the sorting modules on each level to a single conveyor belt 1432 that is medially disposed between the parallel sets of stacked sorting modules.

Each level of sorting modules in the sorting stacks is equipped with a similar set of output chutes.

In this embodiment shrimp are graded at a rate equal to the sorting rate of each individual module stack times the number of stacks in the apparatus, which may be arbitrarily large. The combined output of all the sorting modules in each grade are deposited on a conveyor belt and rapidly carried out of the apparatus to be quick frozen or otherwise stored.

The embodiment of the present invention shown in FIG. 14 is adapted to operate over water. The final sorting module is equipped with a dumping conduit 1434 which takes the trash shrimp from the larger disk of the lowest module and returns them by gravity to the sea. In a shore based operation, a final conveyor belt would be placed under these chutes for removal of waste.

FIG. 15

Figure 15:
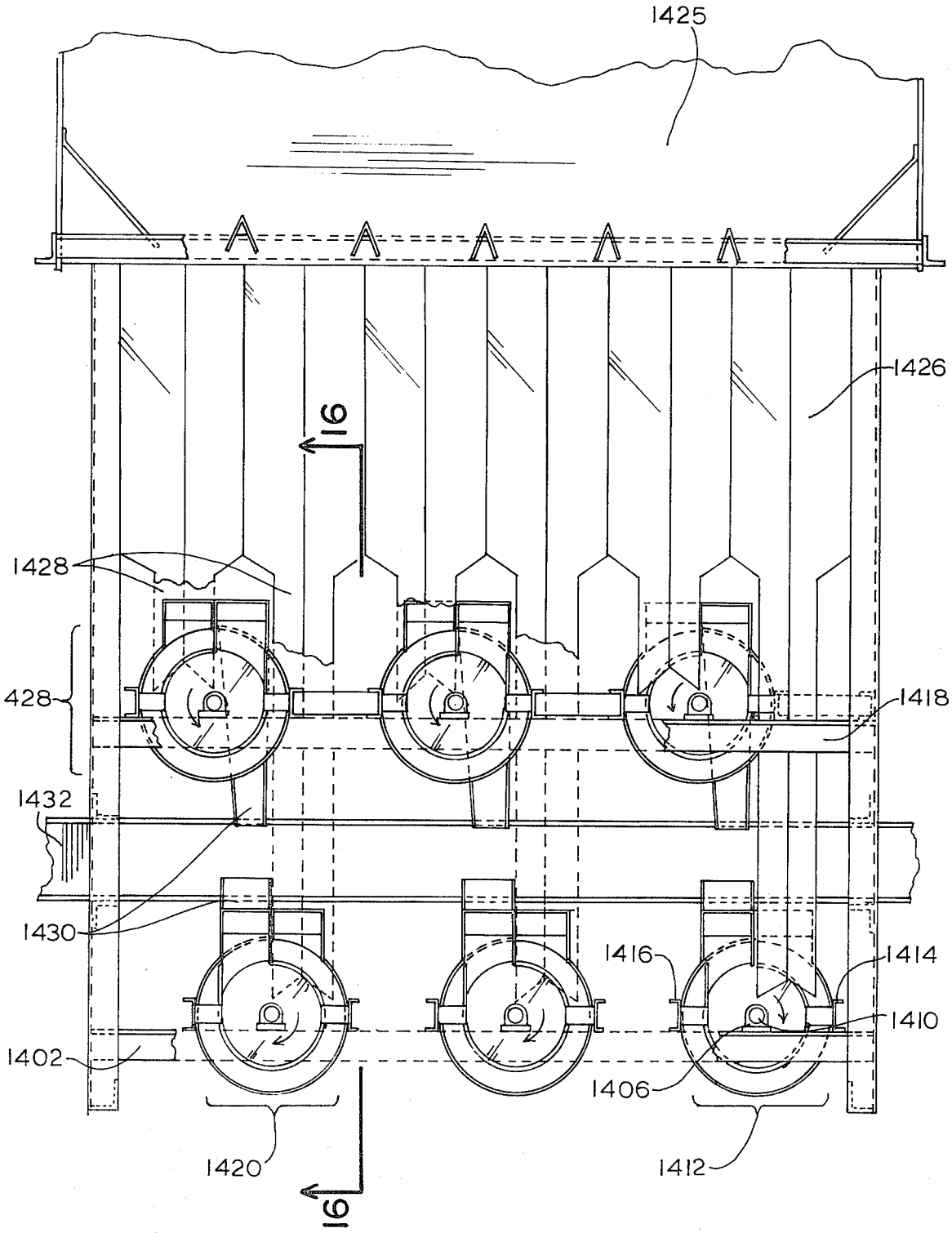
FIG. 15 is a view of the apparatus shown in FIG. 14 taken along section lines 15—15 illustrating an overhead view of the sorting system.

FIG. 15 is a plane view of a multiple module stack sorter embodiment of the present invention taken along lines 15—15 of FIG. 14. FIG. 15 is an overhead view of the parallel sorter discussed above. Like figures indicate like structures.

Shrimp are dumped from the boat's catch onto moving belt 1425, which in turn dumps them onto vibrating multiple v-trough assembly 1426. The shrimp are individually longitudinally aligned and separated. They then pass from the v-trough into delivery troughs 1428. Delivery troughs 1428 deliver individual shrimp to the smaller upper disk of the top sorting module of each of the six module stacks in the apparatus. The three stacks, of which sorting stack 1422 is one, rotate counterclockwise, as viewed from above. The other group of three sorting modules, of which stacks 1412 and 1420 are a part, rotate clockwise as seen from above.

FIG. 16

Figure 16:
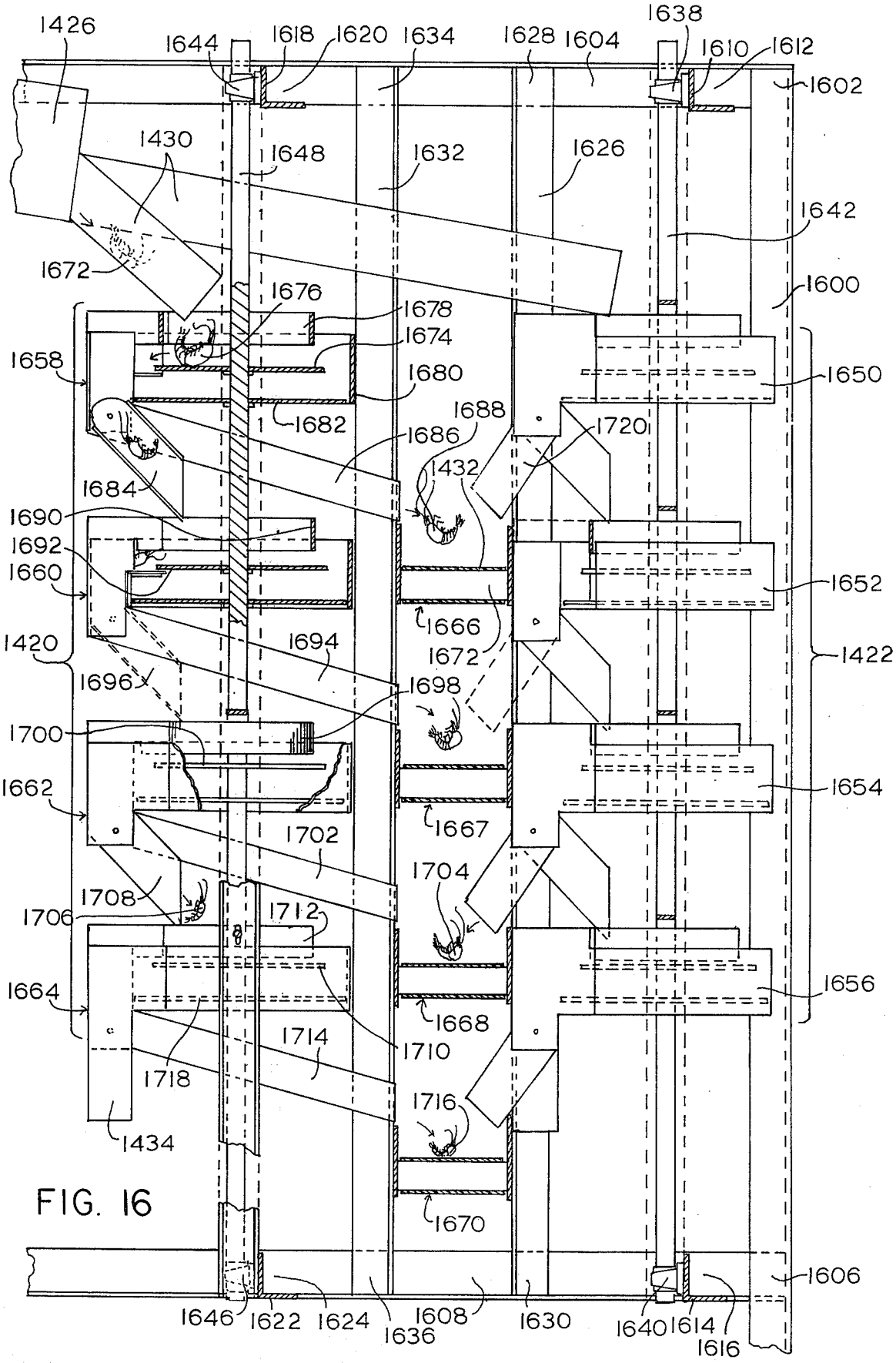
FIG 16 is a view taken along lines 16—16 of FIG. 15 illustrating two stacked sorting columns constructed according to the second preferred embodiment of the present invention.

FIG. 16 is a plane view taken through the apparatus shown in FIG. 15 along lines 16—16 of FIG. 15. FIG. 16 has a detailed view of two parallel sorting stacks that is partially cutaway to show their operation. Like numbers indicate like structures.

Vertical structural support 1600 is joined at its top end 1602 by welding, bolting or other means to top horizontal support member 1604 which runs to the left out of the drawing. Vertical support 1600 is joined near its bottom end at point 1606 by welding, bolting or other means to lower horizontal support structural member 1608, which also runs to the left out of the Figure.

First upper horizontal bearing support member 1610 runs into the plane of the drawing and is attached to upper horizontal support member 1604 at point 1612. First lower horizontal bearing support structural member 1614 is attached to lower horizontal structural support member 1608 at point 1616 by welding, bolting or other suitable means and also runs into the plane of the drawing. Second upper horizontal bearing support structural member 1618 is attached to upper horizontal support member 1604 at point 1620 and also runs into the plane of the drawing. Second lower horizontal bearing support structural member 1622 is attached to lower horizontal structural member 1608 by bolting or welding at point 1624 and runs into the plane of the drawing.

First vertical belt support structural member 1626 is attached at its upper end 1628 to upper horizontal structural support member 1604 and at its lower end 1630 to lower horizontal structural support member 1608. Second vertical belt support structural member 1632 is attached at its upper end 1634 to upper horizontal structural support member 1604 and its lower end 1636 to lower horizontal structural support member 1608.

Bearing 1638 is horizontally mounted on structural support member 1610 and lower bearing 1640 is horizontally mounted on structural support member 1614. Shaft 1642 is rotatably mounted at its upper end to bearing 1638 and at its lower end to bearing 1640. Bearing 1644 is horizontally mounted on structural member 1618 and lower bearing 1646 is horizontally mounted on structural member 1622. Vertical shaft 1648 is rotatably mounted at its upper end in bearing 1644 and at its lower end in bearing 1646.

Module stack 1422 has four sorting modules 1650, 1652, 1654 and 1656, from top to bottom, respectively. Sorting stack 1420 has four sorting modules 1658, 1660, 1662 and 1664, listed from top to bottom, respectively. These sorting modules have been exhaustively described in great detail in connection with FIGS. 8 through 13 above. The individual parts will not be numbered except in connection with a description of the function of the device as necessary to prevent confusion.

Conveyor belt assemblies 1666, 1667, 1668 and 1670 are mounted horizontally between support 1632 and 1626. Each of the conveyor belt assemblies has a plurality of rollers such as roller 1672 and rubberized belt such as 1432 shown in connection with conveyor belt assembly 1666. Construction of such conveyor belt assemblies is well within the ability of those skilled in the art of mechanical engineering. Therefore the belt assemblies will not be described in any great detail.

All the materials used in the present invention must be highly resistant to corrosion because the device will normally operate in a spray of water. Depending on location of the unit this may be a spray of salt water. The driving mechanisms for rotating shafts 1648, 1642 have been deleted from FIG. 16 in the interest of clarity. These driving mechanisms have been discussed in detail in connection with FIGS. 1 and 8 above. Additionally, such driving mechanisms are well known to mechanical engineers and their construction would be within the capacity of those skilled in the art.

Function

The operation of sorting stack 1420 will be described first.

Shrimp 1672 has exited the end of v-trough assembly 1426 and is passing through the shorter branch of transfer chute 1430 to be deposited on upper rotating platform 1674 of upper sorter module 1658. Shrimp 1676 is shown just prior to its passing through gauging space between gauging strip 1678 and disk 1674. Once it passes through the annular opening between the circumferential edge of disk 1674 and the inner surface of cylindrical wall 1680 and falls onto lower disk 1682 will be carried around and impelled out transfer chute 1684 onto the upper disk of sorting module 1660.

Shrimp that are too large to pass through the gauging space will be retained by gauging strip 1678 and will pass through chute 1686, i.e. shrimp 1688. Such a shrimp will be deposited on the upper surface 1432 of conveyor belt assembly 1666 and will pass out of the invention.

The shrimp that are retained by lower disk 1682 and cylindrical wall 1680 deposited by chute 1684 into the upper disk of sorting module 1660. The shrimp are there sorted exactly as they were sorted in module 1658. Gauging strip 1690 in module 1660 is set closer to disk 1692. This provides a smaller gauging space to sort the smaller shrimp passing through this module. Again the shrimp retained by gauging strip 1690 are impelled into product output chute 1694 which transports them to conveyor belt assembly 1667. This conveyor belt transports the graded shrimp out of the invention. The shrimp that pass under the gauging strip 1690 of sorting module 1660 pass out of the sorting module through transfer chute 1696 and are deposited onto the upper disk of sorting module 1662. The gauging strip 1698 of sorting module 1662 is set still closer to disk 1700 and the shrimp are again sorted. The larger shrimp retained by the gauging strip pass through output chute 1702 to conveyor belt assembly 1668, i.e. shrimp 1704. The smaller shrimp, i.e. shrimp 1706 are impelled into transfer chute 1708, deposited on disk 1710 of lowest sorting module 1664. Gauging strip 1712, sorting module 1664 is set so as to define a gauge opening between its lower edge and the upper surface of disk 1710 that will retain the smallest shrimp that are commercially valuable. These shrimp pass out of the sorting module through output chute 1714 and all the remaining commercially valuable shrimp, i.e. shrimp 1716 are deposited on conveyor belt assembly 1670 and pass out of the invention. Commercially worthless shrimp fall through the gauging space onto the lower disk 1718 of sorting module 1664 and are impelled into waste refuse chute 1434. As shown, waste refuse chute 1434 is adapted to dump the waste shrimp directly back into the sea. Alternatively a conveyor belt may be provided to remove this trash.

Sorting modules 1650, 1652, 1654 and 1656 and sorter stack 1422 receive input shrimp from the longer members of transfer troughs 1430 and sort the shrimp in exactly the same manner as do their corresponding sorting modules in sorter stack 1420, described above. The gauging strips on each of the sorters in sorter stack 1422 are set to the same height as is the sorting strip in their corresponding module in stack 1420. The only difference between the two modules is that shaft 1642 rotates opposite to the direction of shaft 1648, as is shown by the arrows in FIG. 16 and the output product chutes of the sorting modules are shorter so as to deposit the sorted shrimp onto the conveyor belts. For example, output chute 1720 of sorter module 1650 deposits shrimp retained by the gauging strip of module 1650 onto belt 1432 of conveyor belt assembly 1666.

The preferred embodiments described above are not intended to limit the scope of the invention but are provided only to enable anyone skilled in the art to make and use the device. The invention should be limited only by the following claims and their equivalents.

We claim:

1. A sorting apparatus for physically separating marine animals of diverse size comprising:

a housing having a top and a bottom; and at least one sorting module comprising:

a shaft rotatably affixed to said housing;

at least one disk affixed to and adapted to rotate with said shaft;

at least one gauging strip, said strip being bifrucated at its terminal end into inner and outer branches, affixed to said housing, said strip being positioned above and parallel to the upper surface of said disk inwardly proximate the disk's perimeter, whereby said strip defines a gauging gap between said strip's lower edge and the surface of said disk;

an outer wall attached to said housing positioned outwardly annularly proximate said disk, said wall extending from proximate said disk to at least the height of said gap, said wall terminating prior to the bifrucated terminal end of said strip, delivery means for delivering marine animals to be sorted to a point on said disk radially inward of said gauging strip substantially ahead of its bifrucated terminal end;

prime mover means operationally attached to said shaft for imparting sufficient torque to said shaft, to cause the disk to rotate so said marine animals are impelled toward the disk's perimeter; and at least a first and a second product receiving means located radially outward and below two different points on the perimeter of said disk for receiving marine animals after they have been separated by said gauging gap.

2. A sorting apparatus as in claim 1 wherein said first product receiving means is a chute located in alignment with and beneath said outer arm so as to receive the sorted marine animals that pass through the gauging gap; and said second product receiving means is a chute located rotationally beyond and below the terminus of said inner arm so as to receive the sorted marine animals that are retained by the gauging strip.

3. A sorting apparatus as in claim 2 wherein said disks rotate at least fast enough to cause marine animals smaller than the gauging gap to pass through the gauging strip.

4. A sorting apparatus as in claim 2 including at least one transport means disposed approximate and beneath a chute for carrying away sorted marine animals.

5. A sorting apparatus for physically separating marine animals of diverse size comprising:

a housing having a top and a bottom and at least one sorting module comprising:

a shaft rotatably affixed to said housing;

at least two disks of different diameters the lower disk being of greater diameter than the upper disk, both said disks being orthogonally affixed to and adapted to rotate with said shaft, at least on gauging strip affixed to said housing, said strip being positioned above and parallel to the upper surface of the upper disk and proximate the perimeter thereof, whereby said strip defines a gauging gap;

a wall attached to said housing positioned outwardly annularly proximate said lower disk, said wall extending vertically from proximate the perimeter fo said lower disk to at least the height of the lower edge of said gauging strip; and delivery means for deliving marine animals to be sorted to a point on said disk radially inward of said gauging strip substantially ahead of its terminal end;

prime mover means operationally attached to said shaft for imparting sufficient torque to said shaft to cause the attached disk to rotate so said marine animals are impelled toward the disk's perimeter; and a first product receiving means for receiving marine animals after they have been separated by the gauging gap, comprising a chute positioned outward and just below the perimeter of said upper disk and radially coincident with the opening in said gauging strip and a second product receiving means, for receiving the remainder of the marine animals separated by the gauging strip, comprising a chute positioned outward and just below the perimeter of said lower disk and radially coincident with an opening in said wall.

6. A sorting apparatus as in claim 5 wherein said disks rotate at least fast enough to cause live shrimp smaller than the gauging gap to pass through the gauging gap.

* * * * *